United States Patent [19]

Silverman

[11] 4,131,464

[45] Dec. 26, 1978

[54] FALSE COLOR PHOTOGRAPHIC ELEMENT AND PROCESS

[76] Inventor: Avrum Silverman, 9512 Braddock Rd., Fairfax, Va. 22032

[21] Appl. No.: 820,023

[22] Filed: Jul. 29, 1977

Related U.S. Application Data

[63] Continuation-in-part of Ser. No. 703,413, Jul. 8, 1976, abandoned, which is a continuation-in-part of Ser. No. 578,397, May 19, 1975, abandoned, which is a continuation-in-part of Ser. No. 447,290, Mar. 1, 1974, abandoned.

[51] Int. Cl.[2] ..... G03C 7/16; G03C 1/76

[52] U.S. Cl. ..... 96/22; 96/55; 96/67; 96/68; 96/69; 96/74

[58] Field of Search ..... 96/5, 69, 74, 68, 67, 96/22, 55

[56] References Cited

U.S. PATENT DOCUMENTS

| | | | |
|---|---|---|---|
| 2,258,187 | 10/1941 | Mannes et al. | 96/69 X |
| 2,393,756 | 1/1946 | Dearing | 96/69 X |
| 3,505,068 | 4/1970 | Becket et al. | 96/68 |
| 3,663,228 | 5/1972 | Wyckoff | 96/74 |
| 3,721,823 | 3/1973 | Lishout et al. | 96/68 X |
| 3,798,037 | 3/1974 | Silverman | 96/74 |

*Primary Examiner*—Edward C. Kimlin
*Assistant Examiner*—Alfonso T. Suro Picó
*Attorney, Agent, or Firm*—McAulay, Fields, Fisher & Goldstein

[57] ABSTRACT

A film or paper for producing a colored image from a monochromatic source image comprising four silver halide emulsion layers. A first layer of slow speed emulsion produces an underexposed negative image while a second layer of slow speed emulsion produces an underexposed positive image. The two remaining layers of fast speed emulsion produce an overexposed positive image and an overexposed negative image.

A novel process is disclosed wherein the film or paper is developed in a first developer and only two emulsion layers given reversal exposure. The four emulsions are then developed to three opposite tonal gradations in the three subtractive primary colors, thereby producing a false color image.

21 Claims, 3 Drawing Figures

FALSE COLOR PHOTOGRAPHIC ELEMENT AND PROCESS

The present application is a continuation-in-part of my copending application Ser. No. 703,413, filed July 8, 1976, entitled "False Color Photographic Element and Process", and now abandoned. This latter application was a continuation-in-part of my application Ser. No. 578,397, filed May 19, 1975, entitled "Advanced Photographic Coloring Element and Process", and now abandoned. This earlier application was, in turn, a continuation-in-part of my application Ser. No. 447,290, filed Mar. 1, 1974, entitled "Improved Photographic Coloring Element and Process", also abandoned.

The present invention relates to a photosensitive element for producing a false color image from a black and white or monochromatic source image, and a process therefor, and represents an improvement over the element and process disclosed in my Pat. No. 3,798,037, issued on Mar. 19, 1974, entitled "Photographic Coloring Element and Process".

Prior art which may have bearing on the present invention includes Van Lishout et al., U.S. Pat. No. 3,721,823, issued Mar. 20, 1973 which discloses a color X-ray film comprising two silver halide emulsion layers which produces two dye images of substantially contrasting color and opposite gradation.

Beckett et al., U.S. Pat. No. 3,505,068, issued Apr. 7, 1970, and Wyckoff, U.S. Pat. No. 3,663,228, issued May 16, 1972, describe color films comprising six silver halide emulsion layers having different overlapping speed sensitivities and multiple filters.

Mannes et al., U.S. Pat. No. 2,258,187, issued Oct. 7, 1941, and Dearing, U.S. Pat. No. 2,393,756, issued Jan. 29, 1946, describe color films comprising four silver halide emulsion layers; three layers producing positive dye images while the fourth layer produces a negative masking image.

My issued U.S. Pat. No. 3,798,037, mentioned above, discloses a photosensitive element having four silver halide emulsion layers. Two of the layers comprise high contrast emulsions while the other two layers comprise low contrast emulsions. All four layers contain color couplers and are developed simultaneously in a color forming developer. The element produces two negative dye images and two positive dye images in cyan, magenta and yellow colors. A false color image is produced from a black and white or monochromatic source image.

In the present invention, a greater degree of control is exercised over the distribution of dye density in the images by color developing the emulsion layers separately, rather than all simultaneously. All four emulsion layers may be free of incorporated couplers, said couplers being present instead in the developing solutions in dissolved state.

In a modified embodiment of the present invention, only two of the four emulsion layers contain couplers. Thus, a simultaneous color forming development of the two layers containing couplers may be followed by separate dye coupling developments of the other two layers, which being free of couplers still remained uncolored.

Accordingly, a photosensitive element for producing a false color image from a monochromatic source image constructed according to the present invention comprises four light sensitive silver halide emulsion layers; one of said layers producing a negative image in a first color out of the colors cyan, magenta and yellow; another of said layers producing a positive image in a second color of said colors cyan, magenta and yellow; the other two layers producing a positive image and a negative image both in the same third color of said colors cyan, magenta and yellow; the four dye images so produced forming three substantially opposite tonal gradations in said first, second and third colors.

A feature of the present invention is to provide a method for producing a false color image from a monochromatic source image which comprises exposing to said source image a photosensitive element having four silver halide emulsion layers, two of said layers containing color couplers; developing silver images in all four emulsion layers and fogging exposures of only two emulsion layers; developing the two emulsion layers containing couplers simultaneously in a color forming developer; developing the other two emulsion layers separately in dye coupling developers; which method produces a negative image in a first color, a positive image in a second color, and a positive image and negative image both in the same third color out of the colors cyan, magenta and yellow; the four dye images forming three substantially opposite tonal gradations in said first, second and third colors; and removing the silver images and any remaining silver halide.

The invention will be more clearly understood by referring to the following detailed description taken in conjunction with the attached drawings. The drawings are a series of sectional views, all drawn to an enlarged scale, which represent various embodiments of the present invention.

Conventional black and white photography deals with the rendering of colors from an original scene into monochromatic tones according to their visual luminosities. The present invention deals with the converse; the rendering of monochromatic tones into colors according to their recorded densities. A correctly exposed black and white photograph contains a smooth continuous scale of gray tones ranging from black at one end of the scale to white at the other end. The photosensitive element of the present invention replaces this full range of gray tones with a complete spectrum. Each color represents a level of density on the original negative. Namely: white, light gray, medium gray, dark gray and black. In a typical example, these five tones will be translated into red, yellow, green, cyan and blue respectively. It is possible to manipulate the false color image so that the desired colors can actually be placed anywhere within the black and white scene depicted.

Thus, the present invention relates to a subtractive color film and process for translating varying shades of gray recorded on black and white film into hues of color on the new film, wherein each hue of color corresponds to a respective shade of gray, white or black. Additional uses of the invention relate to X-ray radiography and infrared and ultraviolet photography.

EXAMPLE 1

Although in the discussion which follows it will be assumed that the photosensitive element is a film to be printed from a black and white negative to produce a color transparency, the element may also be printed from a black and white positive as explained below.

Figure 1:
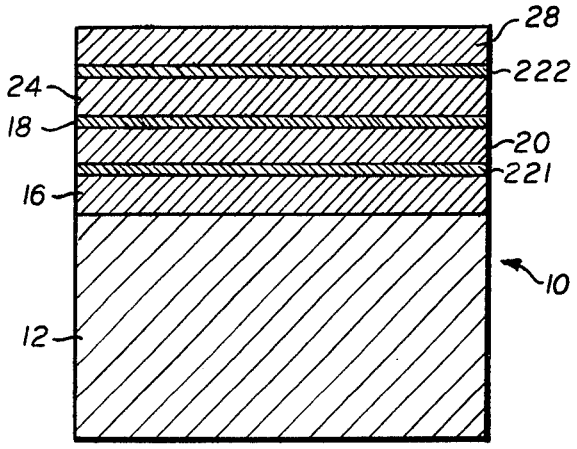
FIG. 1 illustrates an embodiment of the photosensitive element suitable for a transparency film.

The photosensitive element of FIG. 1 is designated generally by the reference numeral 10 and includes a support 12 which may be made of light transmitting material such as cellulose triacetate, cellulose butyrate or polyester. Deposited on the front of the support 12 is a first emulsion layer 16 which is a slow speed panchromatic emulsion which is free of coupler compounds. The layer 16 yields a negative yellow image upon development in a yellow dye coupling developer.

Deposited on the layer 16 is a layer of colloidal silver 221 which serves as a conventional yellow filter and is bleached away during processing. Deposited on the layer 221 is a second emulsion layer 20, which is a fast speed panchromatic emulsion containing a color coupler for cyan which may be 1-hydroxy-2-(N-isoamyl N-phenyl)-naphthamide in the example under consideration. The layer 20 yields a positive cyan image upon color forming development. Deposited on the layer 20 is a plain gelatine interlayer 18.

Deposited on the layer 18 is a third emulsion layer 24, which is a slow speed panchromatic emulsion containing a color coupler for magenta which may be 1-p-laurylphenyl-3-methyl-5-pyrazolone in the example under consideration. The layer 24 yields a positive magenta image upon color forming development. Deposited on the layer 24 is a layer of colloidal silver 222 which serves as a conventional yellow filter and is bleached away during processing.

Deposited on the layer 222 is a fourth emulsion layer 28 which is a fast speed panchromatic emulsion which is free of coupler compounds. The layer 28 yields a negative magenta image upon development in a magenta dye coupling developer. The layers 28 and 24 both produce magenta colored images. However, the image produced in layer 28 is a negative image while the image produced in layer 24 is a positive image.

The element 10 is structured so as to yield positive dye images in the layers 20 and 24, and negative dye images upon reversal development in the layers 16 and 28, superposed on the support 12.

It is necessary to break the tonal range of the continuous tone original negative to produce the false color image. This may be accomplished by the following means. Although layers 16, 20, 24 and 28 may comprise normal contrast emulsions, it is preferable that these layers comprise high contrast emulsions in the example under consideration. A high contrast emulsion is one which shows a great change in density with a small increase or decrease in exposure. Differential exposure of the emulsion layers will then produce the differing densities required. Additionally, the separate dye coupling developments of layers 16 and 28 may be controlled to produce underdeveloped and overdeveloped dye images, thus determining the final distribution of dye density in these layers. Underexposure and/or underdevelopment will result in an image of the type required, while overexposure and/or overdevelopment will also result in an image of the type required.

Accordingly, layers 16 and 24 are fabricated of slow speed emulsions designed to be underexposed in the time allowed for exposure, while layers 20 and 28 are fabricated of fast speed emulsions designed to be overexposed in the time allowed for exposure. In the example under consideration, if the photosensitive element is designed to have an exposure index of "40", then emulsion layers 16 and 24 should preferably have a speed rating of "18", and emulsion layers 20 and 28 should preferably have a speed rating of "100".

The emulsions used in layers 20 and 24 contain a light sensitive silver halide plus a coupler which is capable of producing a dye of the appropriate color. The couplers used in this process may be those having a reactive methylene group, or a reactive phenolic group, or amines, or other non-diffusing or protected coupler compounds. They should preferably be capable of coupling with the oxidation product of primary aromatic amino developing agents, although it is possible to use other developing agents. The couplers may be made diffusion resistant in silver halide emulsion colloid by the use of coupler molecules with fairly long aliphatic carbon chains, or incorporation in droplets of high boiling organic water immiscible liquids (oil formers) or other techniques known in the art.

The special developing solution used is capable of the coupling action which produces dye images in the two emulsion layers which contain couplers, as well as simultaneously reducing the exposed silver halide grains to metallic silver in all four emulsion layers. This special developer serves in effect as a color and black and white developer combined, and is formulated according to the following general method. To the composition of a developing solution containing a color developing agent is added, in approximately equal strength, a black and white developing agent. Thus, in a typical example, if the developing solution includes two grams of the color developing agent 2-amino-5-diethyl amino toluene hydrochloride, then the solution may also include two grams of the black and white developing agent p-Methyl amino phenol sulfate.

The element is exposed and processed according to the following procedure: (No mention is made of the water washings necessary between the various steps.)

A black and white negative (or positive) is printed by contact or projection onto the element 10. This first exposure is made with white light which penetrates and records in the four emulsion layers 16, 20, 24 and 28.

The element is then passed through a combined developer which reduces the exposed silver halide grains in all four emulsions to metallic silver, and simultaneously color develops only the middle two emulsion layers which contain coupler compounds. Thus, a positive image in cyan dye associated with a silver image is produced in layer 20, while a positive image in magenta dye associated with a silver image is produced in layer 24. Because emulsion layers 16 and 28 do not contain couplers these two layers still remain uncolored, but positive silver images have been produced in these layers by the combined developer. One suitable developing solution may be of the following typical composition:

| | | |
|---|---|---|
| Sodium sulfite | grams | 5 |
| Sodium hydroxide | " | 5 |
| 2-amino-5-diethyl amino toluene hydrochloride | " | 2 |
| p-Methyl amino phenol sulfate | " | 2 |
| Water to | cc | 1000 |

The photosensitive element should preferably be overdeveloped during this development.

The element is next passed through a stop-bath which neutralizes the combined developer and halts its action. The element is thereafter evenly fogged in blue light from the bottom, which affects only the bottom emulsion layer 16 as the yellow filter 221 prevents the blue light from reaching the other emulsions. This second exposure forms a negative latent image in the previously unexposed areas of the bottom emulsion. The element is then passed through a developer containing a yellow forming coupler, which produces a negative image in yellow dye associated with a silver image in the bottom layer 16. This layer is preferably overdeveloped.

The element is next passed through a stop-bath which neutralizes the dye coupling developer and halts its action. The element is thereafter evenly fogged in blue light from the top, which affects only the top emulsion layer 28 as the yellow filter 222 prevents the blue light from reaching the other emulsions. This second exposure forms a negative latent image in the previously unexposed areas of the top emulsion. The element is then passed through a developer containing a magenta forming coupler, which produces a negative image in magenta dye associated with a silver image in the top layer 28. This layer is preferably underdeveloped. (Formulations for yellow and magenta dye coupling developers are given below in Example 6.)

The element is next passed through a stop-bath which neutralizes the dye coupling developer and halts its action. The element is now subjected to a bleaching solution such as potassium ferricyanide which converts all of the silver in the element to silver bromide. This includes the yellow filters 221 and 222 which are both made of colloidal silver. A conventional fixing solution (sodium thiosulphate) removes all of the silver bromide leaving only the dye images in layers 16, 20, 24 and 28.

Thus, when the processing is completed, the top and bottom emulsion layers 28 and 16 which received the fogging exposures with blue light will be reversed to negative dye images, while the middle emulsion layers 24 and 20 which received only the initial exposure will have yielded positive dye images.

Note: In certain cases it may be desirable to use two developers in place of the combined developer described above, in which cases the element is developed first in a color forming developer followed by an ordinary black and white developer. If the coupler compounds in the emulsion layers are those specified above, then the color forming developer may be of the following typical composition:

| | | |
|---|---|---|
| 2-amino-5-diethylamino toluene HCl | grams | 2 |
| Sodium sulfite | " | 10 |
| Sodium carbonate | " | 40 |
| Potassium bromide | " | 4 |
| Potassium thiocyanate | " | 1 |
| 6-nitrobenzimidazole | " | 0.1 |
| Water to | cc | 950 |

COLOR TRANSLATION

When the emulsion layers are processed according to the above procedures, their respective gray scales and equivalent dye densities are deformed in a systematic way. The purpose of this deformation of the gray scales and equivalent dye densities is directed toward producing the weighted values, and therefore, the resulting color translation shown in Table I below.

TABLE I

| A GRAY SCALE NORMAL POSITIVE | B GRAY SCALE NORMAL NEGATIVE | C POSITIVE MAGENTA | D NEGATIVE MAGENTA | E NEGATIVE MASKED POSITIVE MAGENTA (GREEN) | F POS. CYAN (RED) | G NEG. YELLOW (BLUE) | H COLOR TRANS. |
|---|---|---|---|---|---|---|---|
| White 8/8 | Black 0 | 8/8 | 0 | 0 | 6/8 | 0 | Red |
| 7/8 | 1/8 | 8/8 | 2/8 | 2/8 | 5/8 | 0 | Orange |
| 6/8 | 2/8 | 8/8 | 4/8 | 4/8 | 4/8 | 0 | Yellow |
| 5/8 | 3/8 | 8/8 | 6/8 | 6/8 | 3/8 | 1/8 | Yel. Gr. |
| 4/8 | 4/8 | 8/8 | 8/8 | 8/8 | 2/8 | 2/8 | Green |
| 3/8 | 5/8 | 6/8 | 8/8 | 6/8 | 1/8 | 3/8 | Bl.Gr. |
| 2/8 | 6/8 | 4/8 | 8/8 | 4/8 | 0 | 4/8 | Cyan |
| 1/8 | 7/8 | 2/8 | 8/8 | 2/8 | 0 | 5/8 | Gr.Bl. |
| Black 0 | White 8/8 | 0 | 8/8 | 0 | 0 | 6/8 | Blue |

Accordingly, Column A illustrates a gray scale for a normal positive and Column B illustrates a gray scale for a normal negative. Columns C, D, F and G correspond to the dye images formed in the respective layers after development. Thus, Column C corresponds to the magenta image formed in layer 24 while Column D corresponds to the magenta image formed in layer 28. The theoretical effect of layers 24 and 28 is summarized in Column E which illustrates the negative masked positive. Column F corresponds to the cyan image formed in layer 20 while Column G corresponds to the yellow image formed in layer 16. Column H is the resulting color translation of a particular shade of gray, white or black.

Ideally, in the magenta positive (Column C) the highlights are blank and many tones toward the end of the scale are also blank lacking density. Other tones contrast with each other. The magenta negative (Column D) has the luminances reversed. Ideally, in the cyan positive (Column F) the brightest highlights will be denser than normal with the shadows becoming opaque with density. The yellow negative (Column G) has the luminances reversed. The magenta positive (Column C) and magenta negative (Column D) mask each other, and create what is in effect a completely new scale of transmittance (Column E). Reading across Columns C, D and E line by line reveals that the lower weighted value in Columns C and D always acts as a "light valve" for the higher weighted value in Columns C and D, thereby creating a new value in Column E. (It should be noted that these weighted values are ideal and only approximate.)

Therefore, reading across line 1 shows that Column E which summarizes the theoretical effect of Columns C and D, will transmit no discernible green light. However, Column F will transmit red light. Column G reveals that no discernible blue light will be transmitted. Thus, the resulting translation will be red for line 1 of the Table.

Similarly, the bottom line shows that Column E will transmit no discernible green light and Column F will transmit no discernible red light. On the other hand, Column G will transmit blue light. Thus, the resulting translation will be blue for the bottom line of the Table.

In between red and blue, varying hues will be produced as shown in Column H. (The resultant color of Column H is obtained by adding the weighted values of Columns E, F and G.)

Assigning the subtractive primaries of cyan, magenta and yellow to this system of color translation allows for many combinations of negative, positive, and the composite negative masked positive. Accordingly, the three most useful combinations are detailed in Tables I, II and III. Table II below is similar to Table I but illustrates the results obtained when Column C corresponds to the cyan image formed in layer 24, Column D corresponds to the cyan image formed in layer 28, Column F corresponds to the yellow image formed in layer 20, and Column G corresponds to the magenta image formed in layer 16. In a similar manner, Table III below illustrates the results obtained when Column C corresponds to the yellow image formed in layer 24, Column D corresponds to the yellow image formed in layer 28, Column F corresponds to the magenta image formed in layer 20, and Column G corresponds to the cyan image formed in layer 16.

TABLE II

| A GRAY SCALE NORMAL POSITIVE | B GRAY SCALE NORMAL NEGATIVE | C POSITIVE CYAN | D NEGATIVE CYAN | E NEGATIVE MASKED POSITIVE CYAN (RED) | F POS. YELLOW (BLUE) | G NEG. MAGENTA (GREEN) | H COLOR TRANS. |
|---|---|---|---|---|---|---|---|
| White 8/8 | Black 0 | 8/8 | 0 | 0 | 6/8 | 0 | Blue |
| 7/8 | 1/8 | 8/8 | 2/8 | 2/8 | 5/8 | 0 | Red.Bl. |
| 6/8 | 2/8 | 8/8 | 4/8 | 4/8 | 4/8 | 0 | Magenta |
| 5/8 | 3/8 | 8/8 | 6/8 | 6/8 | 3/8 | 1/8 | Bl.Red |
| 4/8 | 4/8 | 8/8 | 8/8 | 8/8 | 2/8 | 2/8 | Red |
| 3/8 | 5/8 | 6/8 | 8/8 | 6/8 | 1/8 | 3/8 | Orange |
| 2/8 | 6/8 | 4/8 | 8/8 | 4/8 | 0 | 4/8 | Yellow |
| 1/8 | 7/8 | 2/8 | 8/8 | 2/8 | 0 | 5/8 | Yel.Gr. |
| Black 0 | White 8/8 | 0 | 8/8 | 0 | 0 | 6/8 | Green |

TABLE III

| A GRAY SCALE NORMAL POSITIVE | B GRAY SCALE NORMAL NEGATIVE | C POSITIVE YELLOW | D NEGATIVE YELLOW | E NEGATIVE MASKED POSITIVE YELLOW (BLUE) | F POS. MAGENTA (GREEN) | G NEG. CYAN (RED) | H COLOR TRANS. |
|---|---|---|---|---|---|---|---|
| White 8/8 | Black 0 | 8/8 | 0 | 0 | 6/8 | 0 | Green |
| 7/8 | 1/8 | 8/8 | 2/8 | 2/8 | 5/8 | 0 | Bl.Gr. |
| 6/8 | 2/8 | 8/8 | 4/8 | 4/8 | 4/8 | 0 | Cyan |
| 5/8 | 3/8 | 8/8 | 6/8 | 6/8 | 3/8 | 1/8 | Gr.Bl. |
| 4/8 | 4/8 | 8/8 | 8/8 | 8/8 | 2/8 | 2/8 | Blue |
| 3/8 | 5/8 | 6/8 | 8/8 | 6/8 | 1/8 | 3/8 | Red Bl. |
| 2/8 | 6/8 | 4/8 | 8/8 | 4/8 | 0 | 4/8 | Magenta |
| 1/8 | 7/8 | 2/8 | 8/8 | 2/8 | 0 | 5/8 | Bl. Red |
| Black 0 | White 8/8 | 0 | 8/8 | 0 | 0 | 6/8 | Red |

If it is desired to print from a positive, as with motion pictures for example, the exposures are made in the same manner as in printing from a negative. However, after processing the uppermost and bottommost emulsion layers 28 and 16 will have been reversed to positive dye images while the middle emulsions, layers 24 and 20, will have yielded negative dye images. Therefore, the resulting color translation will be exactly the reverse of what is obtained when printing from a negative. That is, Column H of Tables I, II and III will be turned bottom to top and top to bottom. Thus, it is possible to obtain different results from each film; one translation using a negative as the source image and a second using a positive as the source. If the film is manufactured according to Tables I, II and III, then it is possible to produce six different color translations, one of which will be appropriate for the black and white scene depicted.

EXAMPLE 2

While the present invention has been described primarily as a film to be printed from existing photographic material, it is to be emphasized that the photosensitive element may also be utilized as camera film for original photography. Thus, the layer arrangement of FIG. 1 may be used to illustrate an infrared color film which may find application in the field of aerial reconnaissance. While the four emulsion layers are inherently blue sensitive, cyanine dyes may be used to extend the sensitivity of the emulsions into the infrared region.

Emulsion layer 20 contains a color coupler for cyan which may be 1-hydroxy-2-(N-isoamyl N-phenyl)-naphthamide in the example under consideration. Emulsion layer 24 contains a color coupler for yellow which may be n-propyl-p-benzoylacetamino-benzenesulfonate in the example under consideration. Emulsion layers 16 and 28 remain free of coupler compounds, layer 16 being developed in a cyan dye coupling developer and layer 28 being developed in a magenta dye coupling developer.

In this embodiment, layers 16 and 24 may comprise low contrast emulsions while layers 20 and 28 may comprise high contrast emulsions. A low contrast emulsion in one which upon development shows little contrast between different tones of the original subject. The various densities of the image will be flat and indistinct exhibiting an expanded scale of gradation. On the other hand, a high contrast emulsion is one which upon development shows much contrast between different tones of the original subject. The various densities of the image will be very distinct exhibiting a compressed scale of gradation.

While the four emulsion layers may all comprise medium speed emulsions in this embodiment, it is preferable that layers 20 and 28 comprise slow speed emulsions, and that layers 16 and 24 comprise medium speed emulsions.

The element 10 is exposed and processed according to the following procedure: (No mention is made of the stop-baths and water washings necessary between the various steps.)

The element is loaded into a conventional still or motion picture camera. It must be noted that the emulsions are sensitive not only in the infrared region of the spectrum, but also in the blue region. It is therefore necessary to use before the camera lens a deep orange or red filter to absorb blue light, and thus expose the element entirely by infrared radiation. Also, it should be noted that in this example the false color image will be derived from a positive source (an original life scene) whereas in the previous example the source image was negative.

After exposure the element is passed through a combined developing solution (similar with that given in Example 1) which produces a cyan negative image in layer 20 and a yellow negative image in layer 24, which layers contain color couplers. Black silver negative images are simultaneously produced by the same developing solution in layers 16 and 28, which layers are free of coupler compounds. All four emulsion layers are preferably overdeveloped.

The element is now exposed to blue light from the top which affects only the upper emulsion layer 28 as the yellow filter 222 prevents the blue light from reaching the other emulsions. This fogging exposure forms a positive latent image in the previously unexposed areas of the upper emulsion. A positive image in magenta dye is produced in layer 28 by a developer containing a magenta forming coupler. This image is preferably overdeveloped.

The element is next exposed to blue light from the bottom which affects only the bottom emulsion layer 16 as the yellow filter 221 prevents the blue light from reaching the other emulsions. This fogging exposure forms a positive latent image in the previously unexposed areas of the bottom emulsion. A positive image in cyan dye is produced in layer 16 by a developer containing a cyan forming coupler. This image is preferably underdeveloped. (Formulations for magenta and cyan dye coupling developers are given below in Example 6.)

A ferricyanide bleaching solution then converts all of the silver in the element to silver bromide. This includes the yellow filters 221 and 222 which are both made of colloidal silver. A hypo fixing both removes all of the silver bromide leaving negative dye images in layers 20 and 24, and positive dye images in layers 16 and 28. The resulting color translation is according to Table II in this example. However, because the monochromatic source was positive rather than negative, Column H of Table II is turned bottom to top and top to bottom as explained above.

In an alternate method, two developers may be used in place of the combined developer described above. In this case the element is developed first in a color forming developer (similar to that given in Example 1) followed by treatment in an ordinary black and white developer.

EXAMPLE 3

The photochemical spectrum for unsensitized silver halide emulsions includes gamma rays, X-rays, and ultraviolet in addition to blue light. Cyanine dyes may be used to extend the sensitivity of the emulsions into the green, red and infrared regions. It is possible to manufacture a "universal" photosensitive element whose emulsions encompass the entire photochemical spectrum from gamma rays at one extreme to infrared at the other extreme. Thus, at the option of the photographer, any preselected band of monochromatic wavelengths illuminating an object or scene can be recorded and translated into false color images. All four emulsion layers of the element may be exposed to infrared light only, or ultraviolet light only, or direct X-rays only by the use of appropriate filtration. The subsequent fogging exposures of only two emulsion layers may then be made with visible light. Color development will reveal hidden aspects of an original life scene for medical or scientific purposes.

FIG. 1 may be again used to illustrate this embodiment of the photosensitive element which may take the form of a sheet film of large dimension. The support 12 may be made of cellulose triacetate or a polyester such as polyethylene terephthalate. Layer 18 is a plain gelatine interlayer. Layers 221 and 222 are magenta filters made of a dye such as Acid Red 12, C. I. No. 14,835. Magenta filters are used here in preference to yellow or cyan filters, because yellow filters may cut off a portion of the ultraviolet while cyan filters may cut off a portion of the infrared.

The four emulsion layers are basically panchromatic, capable of being exposed by gamma and X-rays, inherently sensitive to ultraviolet with additional sensitivity in the infrared. In the example under consideration, emulsion layer 20 contains a color coupler for cyan while emulsion layer 24 contains a color coupler for magenta. Emulsion layers 16 and 28 remain free of coupler compounds, layer 16 being overdeveloped in a yellow dye coupling developer and layer 28 being underdeveloped in a magenta dye coupling developer. Optionally, layers 16 and 24 may comprise slow speed emulsions while layers 20 and 28 may comprise medium speed emulsions. Also optionally, layers 16 and 24 may comprise high contrast emulsions while layers 20 and 28 may comprise low contrast emulsions.

The element 10 may be exposed by a variety of methods for a variety of purposes.

As an infrared color film: Because the emulsions are sensitive to other regions of the spectrum as well as infrared, it is necessary to place before the camera lens a filter to absorb visible light and ultraviolet so that only infrared radiation will be recorded. Suitable filters are Kodak Wratten Filter No. 87,88A or 89B.

As an ultraviolet color film: The source of radiation is covered with a filter which transmits the invisible ultraviolet but allows no visible radiation to pass which could affect the emulsions. Suitable filters for use over ultraviolet lamps are Corning Glass Color Filter No. 5840, 5860, 5874 or 5970.

As an X-ray color film: The film, being shielded from visible light, is given an exposure with X-rays transmitted through a cast metal part of an industrial machine for instance. The X-rays are produced by a tungsten anti-cathode X-ray tube.

As a false color film: The photosensitive element is printed in white light, by contact or enlargement, from a black and white negative or positive as described in detail in previous examples.

The structure of the element, processing procedures and chemistry in this example are similar to Examples 1 and 2 except that the fogging exposures of emulsion layers 16 and 28 are made with green light. The magenta filters 221 and 222 prevent the green light from reaching the middle two emulsion layers 20 and 24. The magenta dye filters may be rendered permanently colorless by treatment in a reducing agent solution such as sodium hydrosulfite.

The resulting color translation is according to Table I in this example, depending upon whether the source was negative or positive in nature as explained previously.

EXAMPLE 4

Figure 2:
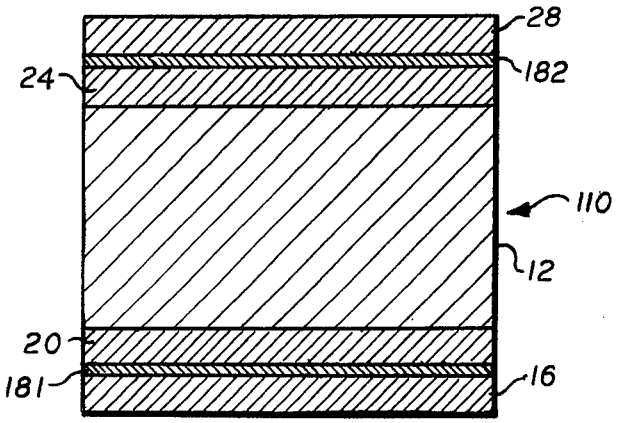
FIG. 2 illustrates an embodiment of the photosensitive element suitable for an X-ray film.

FIG. 2 illustrates a modified embodiment of the present invention which may be utilized in the field of medical radiography to produce a colored X-ray film. The photosensitive element is designated generally by the reference numeral 110. The transparent support 12, which is interposed between the middle two emulsion layers, may be made of cellulose triacetate or polyethylene terephthalate to provide dimensional stability. Layers 181 and 182 are plain gelatine interlayers. The four emulsions 16, 20, 24 and 28 all produce high contrast images, as radiographs while showing skeletal bone structure well are extremely limited in their ability to define soft tissue density. This photographic deficiency perforce creates high contrast images.

The emulsion layers may be selectively sensitized to different colors of the visible spectrum by the addition of spectral sensitizers (commonly cyanine derivatives). Emulsion layer 16 is sensitized to red light while emulsion layer 28 is sensitized to green light. Layers 20 and 24 may remain unsensitized because most emulsions are inherently blue sensitive even without spectral sensitizers being added. Emulsion layer 20 contains a color coupler for yellow while emulsion layer 24 contains a color coupler for magenta. Layers 16 and 28 remain free of incorporated couplers, layer 16 being developed in a yellow dye coupling developer and layer 28 being developed in a cyan dye coupling developer. Also, layers 16 and 24 may comprise fast speed emulsions resulting in overexposure, while layers 20 and 28 may comprise slow speed emulsions resulting in underexposure.

The element is exposed and processed according to the following procedure: (No mention is made of the stop-baths and water washings necessary between the various steps.)

The element 110 is placed in a cassette which shields it from premature exposure by visible light. The element is sandwiched between calcium tungstate or barium lead sulphate intensifying screens which fluoresce under the action of X-rays, the film being exposed on both sides. The element may also be exposed by electrons obtained as a secondary emission from lead screens. To avoid misunderstanding, the images produced on the intensifying screens will be designated as being positive images.

After exposure the element is passed through a combined developing solution which produces a yellow negative image in layer 20 and a magenta negative image in layer 24, which layers contain color couplers. Black silver negative images are simultaneously produced by the same developing solution in layers 16 and 28, which layers are free of coupler compounds. All four emulsion layers are preferably overdeveloped.

The element is now exposed to narrow band green light which forms a positive latent image in the previously unexposed areas of the green sensitized emulsion layer 28. The other emulsions, having different sensitivity, are unaffected by this exposure. A positive image in cyan dye is produced in layer 28 by a developer containing a cyan forming coupler. This image is preferably overdeveloped.

The element is next exposed to narrow band red light which forms a positive latent image in the previously unexposed areas of the red sensitized emulsion layer 16. The other emulsions, having different sensitivity, are unaffected by this exposure. A positive image in yellow dye is produced in layer 16 by a developer containing a yellow forming coupler. This image is preferably underdeveloped.

A ferricyanide bleaching solution followed by a hypo fixing bath removes the associated silver images and any remaining silver halide. This procedure leaves negative dye images in layers 20 and 24 and positive dye images in layers 16 and 28. The resulting color translation is according to Table III in this example. However, because the source image was a positive, Column H of Table III is turned bottom to top and top to bottom.

EXAMPLE 5

Figure 3:
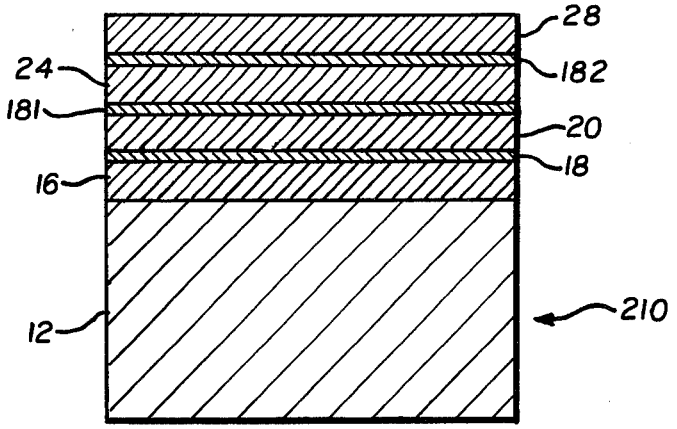
FIG. 3 illustrates an embodiment of the photosensitive element suitable for a printing paper.

FIG. 3 illustrates a further modified embodiment of the present invention which may be utilized as either a photographic film or printing paper. The element of FIG. 3 is designated generally by the reference numeral 210. If the element is to be utilized as a printing paper, the support 12 may be a white reflecting paper base or a white pigmented plastic sheet made of opaque cellulose acetate. Layers 18, 181 and 182 are plain gelatine interlayers.

In the example under consideration emulsion layers 16 and 20 may remain unsensitized (blue sensitive). Emulsion layer 24 is sensitized to red light and emulsion layer 28 is sensitized to green light. Additionally, layer 16 contains a color coupler for yellow while layer 20 contains a color coupler for cyan. Emulsion layers 24 and 28 remain free of coupler compounds, layer 24 being developed in a cyan dye coupling developer and layer 28 being developed in a magenta dye coupling developer. Optionally, layers 16 and 24 may comprise medium speed emulsions while layers 20 and 28 may comprise slow speed emulsions. Also optionally, layers 16 and 24 may comprise low contrast emulsions while layers 20 and 28 may comprise high contrast emulsions.

The element 210 is exposed and processed according to the following procedure: (No mention is made of the stop-baths and water washings necessary between the various steps.)

The element is exposed to a negative source image by white light which penetrates and records in all four emulsions. The element is then passed through a combined developing solution which produces a yellow positive image in layer 16 and a cyan positive image in layer 20, which layers contain color couplers. Black silver positive images are simultaneously produced by the same developing solution in layers 24 and 28, which layers are free of coupler compounds. All four emulsion layers are preferably overdeveloped.

The element is now exposed to narrow band red light which forms a negative latent image in the previously unexposed areas of the red sensitized emulsion layer 24. The other emulsions, having different sensitivity, are unaffected by this exposure. A negative image in cyan dye is produced in layer 24 by a developer containing a cyan forming coupler. This image is preferably overdeveloped.

The element is next exposed to narrow band green light which forms a negative latent image in the previously unexposed areas of the green sensitized emulsion layer 28. The other emulsions, having different sensitivity, are unaffected by this exposure. A negative image in magenta dye is produced in layer 28 by a developer containing a magenta forming coupler. This image is preferably underdeveloped.

A ferricyanide bleaching solution followed by a hypo fixing bath removes the associated silver images and any remaining silver halide. This procedure leaves positive dye images in layers 16 and 20 and negative dye images in layers 24 and 28. The resulting color translation is according to Table II in this example.

EXAMPLE 6

In a further modified embodiment of the present invention, all four emulsion layers of the photosensitive element may be free of incorporated couplers, said couplers being present instead in three developing solutions in dissolved state. It is desirable that the coupler compounds be as soluble as possible in the developing solutions, so that they will be able to penetrate the gelatine or other colloidal material of the element's layers.

Referring again to FIG. 1, the transparent film support 12 may be made of cellulose butyrate or cellulose triacetate or a polyester resin. Layer 18 is a plain gelatine interlayer. The color filter layers 221 and 222 may be made of colloidal silver. The four emulsions may be panchromatic, or sensitized to infrared, or sensitive to ultraviolet or X-rays.

Emulsion layers 20 and 24 should preferably be thicker than emulsion layers 16 and 28 in this embodiment. While the four emulsions may all be of the same normal contrast, preferably, layers 16 and 24 may comprise low contrast emulsions while layers 20 and 28 may comprise high contrast emulsions. Also, while the four emulsion layers may all comprise medium speed emulsions, preferably, layers 16 and 24 may comprise fast speed emulsions while layers 20 and 28 may comprise slow speed emulsions.

The photosensitive element, which is designated generally by the reference numeral 10, is exposed and processed according to the follow procedure: (No mention is made of the water washings necessary between the various steps.)

A black and white negative (or positive) is printed by contact or projection onto the element 10. This first exposure is made with white light which penetrates and records in the four emulsion layers. The element is then passed through a black and white developer of the M.Q. type (metol hydroquinone) to reduce the exposed silver halide grains in all four emulsions to metallic silver. The element is next passed through a stop-bath which neutralizes the black and white developer.

The element is thereafter evenly fogged in blue light from the bottom which affects only the bottom emulsion layer 16. The yellow filter 221 prevents the blue light from reaching the other emulsions. The element is then passed through a developer containing a magenta forming coupler which produces a negative image in magenta dye associated with a silver image in the bottom layer 16. The residual silver halide in thick emulsion layer 20 is simultaneously redeveloped in the same developing solution, without being given a second exposure. This produces a positive image in magenta dye associated with a silver image in layer 20. The magenta developer may have the following typical composition:

| | | |
|---|---|---|
| **Solution A** | | |
| 2-amino-5-diethylaminotoluene HCl | grams | 2 |
| Sodium sulfite | " | 10 |
| Potassium carbonate | " | 50 |
| Potassium bromide | " | 5 |
| 6-nitrobenzimidazole | " | 0.1 |
| Water to 950 cc. | | |
| **Solution B** | | |
| 2-cyanoacetyl coumarone | grams | 2.8 |
| Sodium hydroxide | " | 5 |
| Water | cc | 50 |

(Solution B is added to Solution A.)

The diffusion of this developing solution is carefully controlled so that only emulsion layers 16 and 20 are affected by the solution. The element is next passed through a stop-bath which neutralizes the dye coupling developer.

The residual silver halide in thick emulsion layer 24 is then developed without being given a second exposure by passing the element through a developer containing a cyan forming coupler. This produces a positive image in cyan dye associated with a silver image in layer 24. The cyan developer may have the following typical composition:

| | | |
|---|---|---|
| **Solution A** | | |
| 2-amino-5-diethylamino toluene HCl | grams | 2 |
| Sodium sulfite | " | 10 |
| Sodium carbonate | " | 40 |
| Potassium bromide | " | 4 |
| Potassium thiocyanate | " | 1 |
| 6-nitrobenzimidazole | " | 0.1 |
| Water to 950 cc. | | |
| **Solution B** | | |
| 2,6-dibromo-1,5-dihydroxynaphthol | grams | 0.8 |
| Sodium hydroxide | " | 5 |
| Water | cc | 50 |

(Solution B is added to Solution A.)

The element is next passed through a stop-bath which neutralizes the dye coupling developer. The element is thereafter evenly fogged in blue light from the top, which affects only the top emulsion layer 28. The yellow filter 222 prevents the blue light from reaching the other emulsions. The element is then passed through a developer containing a yellow forming coupler, which produces a negative image in yellow dye associated with a silver image in the top layer 28. The yellow developer may have the following typical composition:

| | | |
|---|---|---|
| **Solution A** | | |
| 2-amino-5-diethylaminotoluene HCl | grams | 2 |
| Sodium sulfite | " | 5 |
| Potassium bromide | " | 1 |
| Sodium carbonate | " | 20 |
| Sodium sulfate | " | 50 |
| Water to 990 cc. | | |
| **Solution B** | | |
| Benzoyl acetoacetanilide | grams | 2.8 |
| Sodium hydroxide | " | 1 |
| Water | cc | 10 |

(Solution B is added to Solution A.)

The element is next passed through a stop-bath which neutralizes the dye coupling developer. The element is then subjected to a bleach such as a ferricyanide solution which converts all of the silver in the element to silver bromide. This includes the yellow filters 221 and 222 which are both made of colloidal silver. A conventional fixing solution such as sodium thiosulphate removes all of the silver bromide leaving only the four dye images.

Thus, when the processing is completed, the top and bottom emulsion layers 28 and 16 which received the fogging exposures with blue light will be reversed to negative dye images, while the middle emulsion layers 24 and 20 which received only the initial exposure will have yielded positive dye images.

As noted above, underexposure and/or underdevelopment results in images of the type required while overexposure and/or overdevelopment also results in images of the type required. The color translation is according to Table I in this example. As described previously, it is possible to obtain quite different results if the element is developed according to Tables II or III.

The developing method of Example 6 may also be used with a color paper as illustrated in FIG. 3, where the white reflecting support 12 is opaque. The four emulsion layers 16, 20, 24 and 28 are made sensitive to blue, blue, red and green respectively, and are free of incorporated couplers. The color paper is given its two fogging exposures from the top with red and green light.

The developing method of Example 6, wherein all four emulsions are free of incorporated couplers, may also be used with an X-ray film as illustrated in FIG. 2. The transparent support 12 is interposed between the middle two emulsion layers 20 and 24. In this case the fogging exposure may be made from both the top and bottom.

EXAMPLE 7

In a further modified embodiment of the present invention, the photosensitive element may be subjected to solarization to produce the required negatives and positives superposed on the same support. This technique is not to be confused with the Sabattier effect, which is often erroneously referred to as "solarization" in common photographic parlance.

Solarization as here defined is the reversal of the image by an extreme amount of overexposure—on the order of one thousand times greater than normal exposure. The element is initially flashed to light of sufficient intensity to produce the maximum developable density in the emulsions. An additional exposure here, in the solarization region of the characteristic curve of a negative emulsion, will actually result in a reduction of density.

Referring to FIG. 1 during the manufacturing process, the element 10 is given an intense exposure in blue light from both the top and bottom. This solarizing exposure affects only emulsions 16 and 28, as the yellow filters 221 and 222 prevent the blue light from reaching the middle two emulsions 20 and 24. An additional exposure will now produce direct negatives when printing from a negative in emulsion layers 16 and 28, and positive images (unsolarized) in emulsion layers 20 and 24.

Referring now to FIG. 3, during the manufacturing process the element 210 is given an intense exposure in yellow light, which affects only emulsion layers 24 and 28 which are sensitized to red and green respectively. Emulsion layers 16 and 20, being unsensitized, are unaffected by this solarizing exposure. An additional exposure will now produce direct positives when printing from a positive in emulsion layers 24 and 28, and negative images (unsolarized) in emulsion layers 16 and 20.

The technique of solarization may be combined with other techniques and developing methods as described previously in Examples 1–6. For instance, a first emulsion layer is given a solarizing exposure followed by normal exposure and development producing a direct positive image. Second and third emulsion layers are given normal exposure and development producing two negative images. The fourth emulsion layer is given normal exposure and development followed by reversal exposure and development producing a positive image. Thus, two positives and two negatives may be produced on the same support using this alternate method.

EXAMPLE 8

All of the previously described embodiments of the present invention required at least three separate developments during the processing regimen, but the photosensitive element of this example requires only two separate developments. As a by-product, this also reduces the number of associated stop-baths and water washings, so that the total number of processing steps is no more than ordinary reversal color processing. This may lead to the invention finding wider acceptance in the medical field where speed and ease of processing are important factors, as well as with those photographers who prefer to develop their own film rather than send it to a commercial laboratory.

FIG. 2 is used here to illustrate a color X-ray film which is designated generally by the reference numeral 110. The transparent support 12 may be made of polyethylene terephthalate. Layers 181 and 182 are plain gelatin interlayers. Layer 16 is an emulsion suitable for solarization, which is sensitized to red in addition to blue and is free of incorporated couplers. Layer 20 is another emulsion suitable for solarization, which remains unsensitized (blue sensitive) and contains a color coupler for magenta. Layer 24 is a normal negative emulsion, which remains unsensitized (blue sensitive) and contains a color coupler for cyan. Layer 28 is a reversal type emulsion, which is sensitized to red in addition to blue and is free of incorporated couplers. The four emulsions are selected for characteristics of speed and contrast, so that upon completion of the developing process they will produce density values in approximate conformity with Table III.

The element 110 is sandwiched between calcium tungstate intensifying screens, placed in a cassette and exposed to the action of X-rays. These intensifying screens fluoresce primarily in the blue and ultraviolet regions of the spectrum, the element being exposed from both sides. To avoid misunderstanding, the images produced on the intensifying screens are designated as being positive images.

After exposure the element is passed through a combined developing solution (similar to that given in Example 1) which produces a cyan negative image in emulsion layer 24, and a magenta positive image in solarized emulsion layer 20, which layers contain couplers. Produced simultaneously by the same developing solution are a black silver negative image in emulsion layer 28, and a black silver positive image in solarized emulsion layer 16, which layers are free of couplers. The element should preferably be overdeveloped during this initial development, as it is desirable that all of the exposed silver halide grains be completely reduced. The element is then passed through a stop-bath.

The element is next evenly fogged in red light from both the top and bottom, affecting only emulsions 28 and 16 which are sensitized to red. The middle two emulsions 24 and 20, being unsensitized are unaffected by this differential reexposure.

The element is next passed through a dye coupling developer containing a yellow forming coupler, which produces a yellow positive image in emulsion layer 28 and a yellow negative image in emulsion layer 16. These two images are preferably underdeveloped during this development. The element is then passed through a stop-bath.

Thus, this shortened processing method differs from the previously described methods in that the top and bottom emulsions receive their fogging exposure simultaneously rather than separately, and are then developed simultaneously in a single dye coupling developer rather than separately in two dye coupling developers.

A ferricyanide bleaching solution followed by a hypo fixing bath removes the associated silver images and any remaining silver halide. This leaves negative dye images in layers 16 and 24 and positive dye images in layers 20 and 28. The resulting color translation is according to Table III. However, because the source image was positive, Column H of the table is turned bottom to top and top to bottom.

In the example under consideration, emulsion layers 16 and 28 are sensitized to red and are reexposed in red light without affecting emulsion layers 20 and 24, which are unsensitized. Alternatively, emulsion layers 16 and 28 may be sensitized to green and reexposed in green light without affecting emulsion layers 20 and 24, which remain unsensitized.

EXAMPLE 9

The shortened developing process may also be applied to a transparency film as illustrated in FIG. 1. The photosensitive element is designated generally by the reference numeral 10. The transparent support 12 may be made of cellulose triacetate. Layer 18 is a plain gelatin interlayer. Layer 16 is a solarized emulsion which remains unsensitized and is free of incorporated couplers. Layer 20 is another solarized emulsion which remains unsensitized and contains a color coupler for yellow. Layer 24 is a normal negative emulsion which remains unsensitized and contains a color coupler for cyan. Layer 28 is a reversal type emulsion which remains unsensitized and is free of incorporated couplers.

Emulsion layers 16, 20, 24 and 28 are selected for characteristics of speed and contrast, so that upon completion of the developing process they will produce density values in approximate conformity with Table I. Layers 221 and 222 are thin emulsions, sensitized to either red or green for convenience, which are prefogged during the manufacturing process at the factory. These thin emulsions are not intended to record an image but function merely as light barriers.

The element is exposed and processed according to the following procedure. A black and white negative (or positive) is printed by contact or projection onto the element 10. This exposure is made with white light which penetrates and records in emulsion layers 16, 20, 24 and 28.

The element is passed through a combined developing solution which produces a cyan positive image in emulsion layer 24, and a yellow negative image in solarized emulsion layer 20, which layers contain couplers. Produced simultaneously by the same developing solution are a black silver positive image in emulsion layer 28, and a black silver negative image in solarized emulsion layer 16, which layers are free of couplers. The thin emulsions 221 and 222, which were pre-fogged during manufacture, develop to metallic silver simultaneously with the dye and silver images and this metallic silver acts as a light barrier during the subsequent differential reexposure. The photosensitive element should preferably be overdeveloped during this initial development. The element is then passed through a stop-bath.

The element is next evenly fogged in white light from both the bottom and top affecting only emulsion layers 16 and 28. The metallic silver light barriers 221 and 222 prevent the light from reaching the middle two emulsions 20 and 24.

The element is next passed through a single dye coupling developer containing a magenta forming coupler, which produces a magenta positive image in layer 16 and a magenta negative image in layer 28. These two images are preferably underdeveloped during this development. The element is then passed through a stop-bath.

A ferricyanide bleaching solution followed by a hypo fixing bath removes the associated silver images, any remaining silver halide, and the metallic silver light barriers 221 and 222. This leaves positive dye images in layers 16 and 24 and negative dye images in layers 20 and 28. The resulting color translation is according to Table I.

Note: The photosensitive element of this example may be transformed into a "universal" element of the type described in Example 3, by merely sensitizing the emulsion layers appropriately. Thus, emulsion layers 16, 20, 24 and 28 may be basically panchromatic, capable of being exposed by gamma and X-rays, inherently sensitive to ultraviolet with additional sensitivity in the infrared. Any preselected band of monochromatic wave-lengths may then be used to expose the element, in conjunction with the appropriate filtration as explained in Example 3.

EXAMPLE 10

The shortened developing process may also be applied to a printing paper as illustrated in FIG. 3. The photosensitive element is designated generally by the reference numeral 210. Layer 12 is an opaque white reflecting support. Layer 16 is a reversal type emulsion which is sensitized to both red and infrared, and is free of incorporated couplers. Layer 18 is a plain gelatine interlayer. Layer 20 is a normal negative emulsion which is sensitized to red, and contains a color coupler for yellow. Layer 181 is a conventional yellow filter made of colloidal silver. Layer 24 is an emulsion suitable for solarization, which remains unsensitized and contains a color coupler for magenta. Layer 182 is a plain gelatine interlayer. Layer 28 is an emulsion suitable for solarization, which is sensitized to green and is free of incorporated couplers.

As the final step in the manufacturing process at the factory, the photosensitive element is flashed to blue light of sufficient intensity to solarize emulsion layers 28 and 24 which are both suitable for this purpose. The yellow filter 181 prevents the blue light from reaching emulsion layers 20 and 16.

The element may now be exposed and processed according to the following procedure. A black and white negative is printed by enlargement onto the element 210. This exposure is made with white light which penetrates and records in the four emulsion layers.

The element is passed through a combined developing solution which produces a yellow positive image in emulsion layer 20, and a magenta negative image in solarized emulsion layer 24, which layers contain couplers. Produced simultaneously by the same developing solution are a black silver positive image in emulsion layer 16, and a black silver negative image in solarized emulsion layer 28, which layers are free of couplers. The photosensitive element should preferably be overdeveloped during this initial development. The element is then passed through a stop-bath.

The element is next evenly fogged in green light from the top, affecting only the top emulsion layer 28 which is sensitized to green. The problem here is to give the bottom emulsion 16 its reversal exposure through intervening emulsion layers (which now contain heavy negative and positive silver images) or through the opaque support 12. This may be accomplished by exposing the element to a strong source of infrared radiation, as emulsion layer 16 has been sensitized to infrared. This infrared fogging exposure may be made simultaneously with the green light fogging exposure of emulsion layer 28.

The element is next passed through a single dye coupling developer containing a cyan forming coupler, which produces a cyan negative image in layer 16 and a cyan positive image in layer 28. These two images are preferably underdeveloped during this development. The element is then passed through a stop-bath.

A ferricyanide bleaching solution followed by a hypo fixing bath removes the associated silver images, any remaining silver halide, and the yellow filter 181 which is made of colloidal silver. This leaves negative dye images in layers 16 and 24 and positive dye images in layers 20 and 28. The resulting color translation is according to Table II.

ALTERNATE EMBODIMENTS

It is to be understood that the above examples are given merely for the purpose of illustration and are not to be taken as limitations. While preferred embodiments of the invention have been shown and described, it should be obvious that numerous omissions, changes and additions may be made in such embodiments without departing from the spirit and scope of the present invention.

The emulsions used in the photosensitive element may comprise any of the silver halides such as silver bromide, silver chloride, silver iodide, silver chlorobromide, silver chloroiodide, silver bromide iodide, silver chlorobromideiodide or mixtures thereof.

The support for the emulsion layers may comprise any supporting material known in the art such as glass, cellulose nitrate, cellulose acetate, cellulose butyrate, cellulose triacetate or a polyester resin such as polyethylene terephthalate.

Other layers may be added to the structure of the photosensitive element as seems desirable. For instance, subbing layers and antistress layers and antihalation layers may be added. An antihalation layer made of colloidal silver may be deposited on the upper side of the support. This layer is subsequently bleached with the silver images. Alternatively, a carbon black layer may be coated on the base side of the support. This prevents halation by absorbing the light rays that pass through the support, and also protects the film from scratches and abrasions.

Additionally, cyan filters may be substituted for the yellow filters in which case the foggiing exposures would be made with red light. Similarly, magenta filters may be substituted for the yellow filters in which case the fogging exposures would be made with green light. The inclusion of these filter layers is optional as the filters can be dispensed with if the four emulsions are sensitized to red, blue, blue and green. The fogging exposures can then be made with red and green light without affecting the blue sensitive emulsions.

The exact order of the slow speed emulsions and fast speed emulsions may be interchanged. Thus, instead of layers 16 and 24 being slow speed and layers 20 and 28 being fast speed, the reverse may be true. Alternatively, layers 16 and 20 may be slow speed and layers 24 and 28 may be fast speed, or the reverse may also be true, etc.

Similarly, instead of emulsion layers 20 and 24 containing the color couplers and emulsion layers 16 and 28 being free of couplers, the reverse may be true. Alternatively, emulsion layers 16 and 20 may contain the color couplers and emulsion layers 24 and 28 may be free of couplers, or the reverse may also be true, etc.

Additionally, the exact location of the composite negative-positive masking images (both of which are the same color) may be changed. These composite masking images need not be confined to the third and fourth layers but may comprise the first and second layers. Alternatively, the composite masking images may comprise the first and third or the second and fourth layers, etc.

The color forming couplers may be incorporated in the emulsion layers or in the developing solutions. General classes of the most useful couplers include phenolic, 5-pyrazolone, heterocyclic and open chain ketomethylene compounds. Color forming compounds of the "fat-tail" variety are disclosed in F.I.A.T. Final Report, No. 721.

The present invention has been described in one embodiment as an element in which all four emulsion layers are manufactured without color couplers, or in another embodiment where two emulsion layers contain color couplers and the other two emulsion layers are free of incorporated couplers. However, it is possible for the element to contain a coupler in only one of the emulsion layers which is developed in a color forming developer, while the other three emulsion layers being free of incorporated couplers are developed separately in dye coupling developers.

In a further modified embodiment, the photosensitive element may comprise six emulsions, two of which are pre-fogged emulsions. These pre-fogged emulsions are substituted for the color filter layers and occupy the same relative positions as the color filters. They are developed to metallic silver during the initial development and this metallic silver completely shields the middle two emulsions from the action of light during the subsequent reversal exposures.

The processing regimen described in Example 6 specifies the use of a black and white developer of the M.Q. type, followed by a stop-bath. However, other black and white developers may be substituted. An amidol black and white developer may be used in which case the stop-bath is eliminated, because amidol carries on development even in an acid medium. Instead the element is thoroughly washed for about 25 minutes.

The composition of the developing solution specified in Examples 1–5 which serves as a color and black and white developer combined may be subject to change. In certain cases it may be desirable to use two developers instead, in which case the element is developed first in a color forming developer followed by an ordinary black and white development.

Additonally, a number of color forming developers have the inherent capacity to serve also as black and white developers, even without the addition of a black and white developing agent to the color solution. For instance, the developer dimethyl-p-phenylenediamine when used with another pair of coupler compounds incorporated in two emulsion layers, will serve as both a color and black and white developer as utilized in Examples 1–5.

The color developing agent 2-amino-5-diethylamino toluene hydrochloride specified in the above examples is a derivative of p-phenylenediamine. Alternate designations may be one of the following:

4-amino-3-methyl diethylaniline hydrochloride

NN-diethyl-3-methyl-p-phenylenediamine hydrochloride 4-diethylamino-o-toluidine hydrochloride.

What is claimed is:

1. A photosensitive element for producing a false color image from a monochromatic source image and the like; comprising four light sensitive silver halide emulsion layers having a composition to produce differing tonal gradations; two emulsion layers containing color couplers and the other two emulsion layers free of color couplers; said photosensitive element having a supoort for supporting the four emulsion layers; said photosensitive element also comprising integral means for the differential reexposure of two emulsion layers; one of said four emulsion layers producing a negative dye image in a first color, another of said four emulsion layers producing a positive dye image in a second color, the remaining two emulsion layers producing a positive dye image and a negative dye image both in the same third color; the four dye images forming three substantially opposite tonal gradations in cyan, magenta and yellow colors.

2. A photosensitive element as in claim 1, in which said support is a transparent film support.

3. A photosensitive element as in claim 1, in which said support is a white reflecting support.

4. A photosensitive element as in claim 1, in which said composition comprises two slow speed emulsion layers and two medium speed emulsion layers.

5. A photosensitive element as in claim 1, in which said composition comprises two low contrast emulsion layers and two high contrast emulsion layers.

6. A photosensitive element as in claim 1, in which said integral means comprise a color filter layer between the first and second emulsion layers and another color filter layer between the third and fourth emulsion layers.

7. A photosensitive element as in claim 1, in which said integral means comprise a pre-fogged emulsion between the first and second emulsion layers and another prefogged emulsion between the third and fourth emulsion layers.

8. A photosensitive element as in claim 1, in which said integral means comprise a first emulsion layer sensitized to red light and a fourth emulsion layer sensitized to green light, and the second and third emulsion layers remain unsensitized.

9. A photosensitive element as in claim 1, in which two emulsion layers are solarized and the other two emulsion layers are unsolarized.

10. A photosensitive element as in claim 1, in which said four emulsion layers are sensitive to the X-ray region of the spectrum.

11. A photosensitive element as in claim 1, in which said four emulsion layers are sensitive to the ultraviolet region of the spectrum.

12. A photosensitive element as in claim 1, in which said four emulsion layers are sensitized to the infrared region of the spectrum.

13. A photosensitive element as in claim 1, in which said four emulsion layers are unsensitized.

14. A photosensitive element as in claim 1, in which said four emulsion layers have panchromatic sensitivity.

15. The method of producing a false color image from a monochromatic source image and the like; which comprises exposing to said source a photosensitive element with four silver halide emulsion layers having a composition to produce differing tonal gradations, two emulsion layers containing color couplers, said element also comprising integral means for differential reexposure of two emulsion layers; developing said two emulsion layers containing couplers in a color forming developer; developing silver images in said four emulsion layers; differential reexposure of two emulsion layers; developing the two reexposed emulsion layers by dye coupling development; which method produces a negative image in a first color, a positive image in a second color, and a positive image and negative image both in the same third color; these four dye images forming three substantially opposite tonal gradations in cyan, magenta and yellow colors; and removing the silver images and any remaining silver halide.

16. The method of producing a false color image from a monochromatic source image and the like; which comprises exposing to said source a photosensitive element with four silver halide emulsion layers having a composition to produce differing tonal gradations, one emulsion layer containing a color coupler and the other three emulsion layers free of color couplers, said element also comprising integral means for differential reexposure of two emulsion layers; developing said emulsion layer containing a color coupler in a color forming developer; developing silver images in said four emulsion layers; differential reexposure of two emulsion layers; developing said other three emulsion layers separately in dye coupling developers; which method produces a negative image in a first color, a positive image in a second color, and a positive image and negative image both in the same third color; these four dye images forming three substantially opposite tonal gradations in cyan, magenta and yellow colors; and removing the silver images and any remaining silver halide.

17. The method of producing a false color image from a monochromatic source image and the like; which comprises exposing to said source a photosensitive element with four silver halide emulsion layers having a composition to produce differing tonal gradations, two emulsion layers containing color couplers, said element also comprising integral means for differential reexposure of two emulsion layers; developing said two emulsion layers containing couplers in a color forming developer; developing silver images in said four emulsion layers; differential reexposure of two emulsion layers; developing the two reexposed emulsion layers separately in dye coupling developers; which method produces a negative image in a first color, a positive image in a second color, and a positive image and negative image both in the same third color; these four dye images forming three substantially opposite tonal gradations in cyan, magenta and yellow colors; and removing the silver images and any remaining silver halide.

18. The method of producing a false color image from a monochromatic source image and the like; which comprises exposing to said source a photosensitive element with four silver halide emulsion layers having a composition to produce differing tonal gradations, two emulsion layers containing color couplers, said element also comprising integral means for differential reexposure of two emulsion layers; developing said element in a solution containing both color and black and white developing agents, which produces dye images in said two emulsion layers containing couplers and silver images in said four emulsion layers; differential reexposure of two emulsion layers; developing the two reexposed emulsion layers separately in dye coupling developers; which method produces a negative image in a first color, a positive image in a second color, and a positive image and negative image both in the same third color; these four dye images forming three substantially opposite tonal gradations in cyan, magenta and yellow colors; and removing the silver images and any remaining silver halide.

19. The method of producing a false color image from a monochromatic source image and the like; which comprises exposing to said source a photosensitive element with four silver halide emulsion layers having a composition to produce differing tonal gradations, two emulsion layers containing color couplers and two emulsion layers being solarized, said element also comprising integral means for differential reexposure of two emulsion layers; developing said two emulsion layers containing couplers in a color forming developer; developing silver images in said four emulsion layers; differential reexposure of two emulsion layers; developing the two reexposed emulsion layers simultaneously in a dye coupling developer; which method produces a negative image in a first color, a positive image in a second color, and a positive image and negative image both in the same third color; these four dye images forming three substantially opposite tonal gradations in cyan, magenta and yellow colors; and removing the silver images and any remaining silver halide.

20. The method of producing a false color image from a monochromatic source image and the like; which comprises exposing to said source a photosensitive element with four silver halide emulsion layers having a composition to produce differing tonal gradations, two emulsion layers containing color couplers and two emulsion layers being solarized, said element also comprising integral means for differential reexposure of two emulsion layers; developing said element in a solution containing both color and black and white developing agents, which produces dye images in said two emulsion layers containing couplers and silver images in said four emulsion layers; differential reexposure of two emulsion layers; developing the two reexposed emulsion layers simultaneously in a dye coupling developer; which method produces a negative image in a first color, a positive image in a second color, and a positive image and negative image both in the same third color; these four dye images forming three substantially opposite tonal gradations in cyan, magenta and yellow colors; and removing the silver images and any remaining silver halide.

21. The method of claim 15, in which said removing the silver images and any remaining silver halide is effected by treating said element with a bleaching solution and a fixing bath.

* * * * *